US006307457B1

(12) United States Patent
Wissink et al.

(10) Patent No.: US 6,307,457 B1
(45) **Date of Patent: *Oct. 23, 2001**

(54) PLANAR TRANSFORMER

(75) Inventors: Wouter M. Wissink, Baarle Hertog (BE); Pieter J. M. Smidt, Eindhoven; Jan W. Arets, Budel, both of (NL)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/210,418

(22) Filed: Dec. 11, 1998

(30) Foreign Application Priority Data

Dec. 17, 1997 (EP) ..... 97203970

(51) Int. Cl.[7] ..... H01F 5/00
(52) U.S. Cl. ..... 336/200; 336/232; 336/223
(58) Field of Search ..... 29/602.1; 336/200, 336/232, 223

(56) References Cited

U.S. PATENT DOCUMENTS

| | | | | |
|---|---|---|---|---|
| 4,873,757 | * | 10/1989 | Williams | 29/602.1 |
| 5,010,314 | | 4/1991 | Estrov | 336/198 |
| 5,184,103 | * | 2/1993 | Gadreau et al. | 336/232 |
| 5,532,667 | * | 7/1996 | Haertling et al. | 336/232 |
| 5,610,433 | | 3/1997 | Merrill et al. | 257/531 |
| 5,612,660 | | 3/1997 | Takimoto | 336/200 |

FOREIGN PATENT DOCUMENTS

| | | | | |
|---|---|---|---|---|
| 2230587 | * | 4/1980 | (DE) | 336/200 |
| 0506362 | | 9/1992 | (EP) . | |
| 3-78218 | * | 4/1991 | (JP) | 336/200 |
| 3-183106 | * | 8/1991 | (JP) | 336/200 |
| 3-283404 | * | 12/1991 | (JP) | 336/200 |
| 5-135968 | * | 6/1993 | (JP) | 336/200 |
| 5-59818 | * | 6/1993 | (JP) | 336/200 |

* cited by examiner

*Primary Examiner*—Anh Mai
(74) *Attorney, Agent, or Firm*—Aaron Waxler

(57) ABSTRACT

Planar windings of the secondary coil have outward extending portions which on the outside, so that the vias are situated at a larger distance from the core. In a planar transformer, also the turns of the primary coil may extend parallel to each other. In this manner, it is possible to further reduce the size of the transformer, while the power loss is minimal.

9 Claims, 4 Drawing Sheets

PLANAR TRANSFORMER

BACKGROUND OF THE INVENTION

The invention relates to a planar transformer comprising a magnetic core as well as a number of layers on which the spiral-shaped winding portions of a primary and secondary coil are provided, whereby winding portions belonging either to a winding of the primary coil or to a winding of the secondary coil are interconnected by means of one or more vias.

A transformer of this type is known from U.S. Pat. No. 5,010,314.

Transformers are necessary in many types of electrical apparatus. In an apparatus which is connected to a mains voltage which is higher than the voltage used at least in parts of the equipment, in general a transformer is used to reduce this voltage.

In general, a transformer comprises a primary coil, a secondary coil and a core. The coils may be made, for example, of copper wire. They may be arranged so as to be juxtaposed. Alternatively, they may be arranged so that one coil surrounds another coil. A coil has one or more windings. As a result of the ongoing reduction in size of electrical apparatus, also the transformers manufactured comprise coils having smaller dimensions. Said coils may be made, for example, of a number of layers of an insulating material on which winding portions of the coils are provided. A transformer of this type is referred to as a multilayer or planar transformer.

The winding portions of a planar transformer may be provided, for example, by means of a printing process. The winding portions of a coil may be externally interconnected. But preferably they are interconnected by means of so called vias. Vias are metallized through holes. If use is made of vias, insulated bridges can be dispensed with, as a result of which the transformer is easier and cheaper to manufacture.

The core of a transformer is preferably made of a material which is a good conductor of magnetic lines of force (for example ferrite). This core is situated partly inside the coils and partly outside the coils. If a current is sent through the primary coil, magnetic flux causes a current to be generated in the secondary coil. The core conducts this flux since it is made of a material having good magneto-conductive properties. During operation, the primary coil is connected to the mains and the secondary coil is connected to the current circuit of the apparatus receiving energy from the mains.

As a result of the ongoing reduction in size of equipment, a further reduction in size of the planar transformers is desirable. A problem associated with a further miniaturization is the higher risk of breakdown during operation, which presents a danger to the user of the equipment.

SUMMARY OF THE INVENTION

The object of the invention is achieved by a planar transformer wherein winding portions of the secondary coil have outward extending portions connected by vias.

It has been found that the higher risk of breakdown is caused, inter alia, by the fact that a further reduction in size of the transformer causes the vias of the coils to become situated too close to the core. In the vias there is air. Air is a better conductor of magnetism than the insulating material of the layers on which the windings of the coils are printed, so that the breakdown voltage through air is lower than that through the insulating material. As a result, the distance between the primary and secondary coil through air must be relatively large. The air gap between the two coils must be at least 6 mm in order to properly separate the coils from each other and sufficiently reduce the risk of breakdown. The material of the core is an even much better conductor of the magnetic lines of force than air. There is no separation whatsoever between the coils if they are in contact with each other exclusively via the core. The distance through the core does not count as it were. So, if the vias of two coils are both close to the core, then, in fact, these vias are situated close to one another. Thus, the smallest distances from the vias to the core should together be less than 6 mm, which is the smallest permissible distance through air.

A reduction in size of planar transformers, without an increased risk of breakdown during operation, can alternatively be achieved by providing a single layer with two juxtaposed winding portions of a primary coil. This results in a transformer which is more compact and cheaper.

DETAILED DESCRIPTION OF THE PREFERRED EMBODIMENTS

Figure 1:
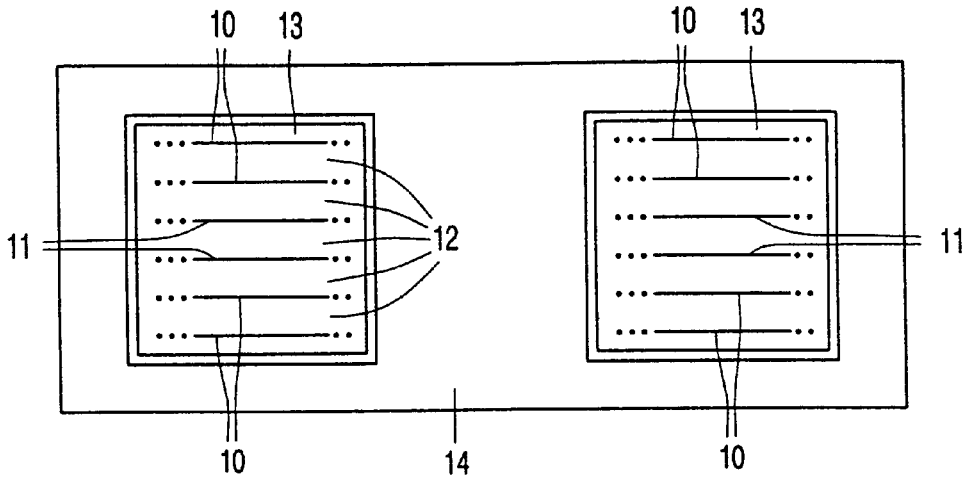
FIG. 1 PRIOR ART
FIG. 1 is a schematic cross-sectional view of an embodiment of a planar transformer in accordance with the prior art.

In the prior art transformer of FIG. 1 there are a number of primary windings (10) and secondary windings (11), which are provided on a number of stacked layers (12) of an electrically insulating material, which layers together form a block (13). A core (14) is present around the windings. The transformer coils may also be cast into an electrically insulating material (not shown). This material preferably has a breakdown voltage of at least 3 kV. If the breakdown voltage is approximately 3 kV, then the distance between the coils must be at least 0.4 mm. The distance through air must be at least 6 mm. If an electrically insulating material is used between the coils, the minimum distance can be smaller, thus enabling the transformer to be reduced in size. The lower limit can be achieved by providing the coils in a planar arrangement on layers of the electrically insulating material. If this process is carried out by means of a printing technique, such as screen printing or photolithography, a high accuracy can additionally be attained. The coil system of the transformer is manufactured by providing the layers of material with coils and pressing them onto each other, thereby forming a single block of material.

The prior art planar transformer as shown in FIG. 1 is much smaller than a conventional transformer in which the windings are situated in air. An aspect which is of particular importance is that the planar transformer is much thinner. However, the dimensions of the transformer still determine the minimum dimensions of the electronic system. Reducing the size of other components has no effect. A reduction in size of the electronic system must be preceded by a reduction in size of the transformer.

In a planar transformer, a winding of a coil generally comprises at least two winding portions. This is convenient because a flat coil is generally spiral-shaped. If the winding has only a single winding portion on a single layer, it becomes problematic to connect the internally situated end thereof to a voltage source. This problem can be solved by providing an insulated bridge over the rest of the coil. The end portion of the spiral-shaped winding portion, which is situated inside the spiral, is then connected to a contact point situated outside the spiral by means of a conductor which is provided over the spiral. To avoid a short-circuit between this conductor and the coil, an electrically insulating path, referred to as bridge, must be situated between the conductor and the coil.

Figure 2A:
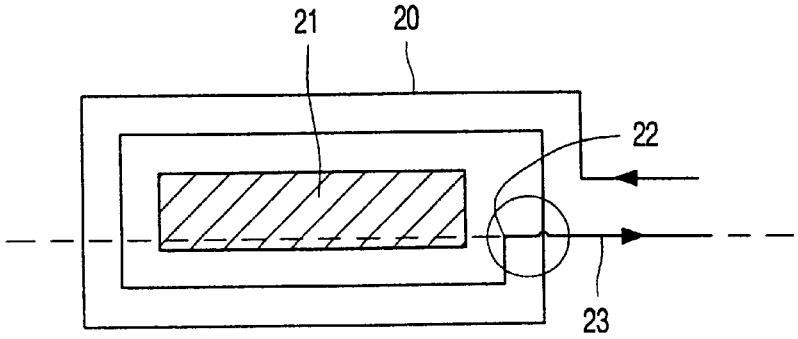
FIG. 2A PRIOR ART
FIG. 2A is a cross-sectional view of an embodiment of a prior art planar transformer having an insulated bridge at the location of one of the spiral-shaped winding portions of the secondary coil.
Figure 2B:
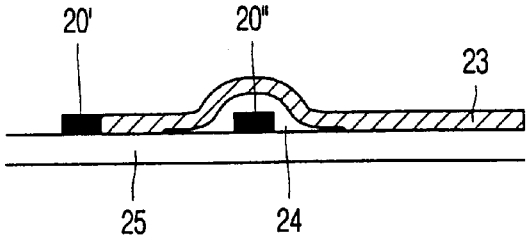
FIG. 2B PRIOR ART
FIG. 2B is a cross-sectional view of the embodiment of a prior art planar transformer having an insulated bridge as shown in FIG. 2A, at the location of the insulated bridge, along the interrupted line.

FIGS. 2A and 2B show how a winding portion (20) is situated around a core (21). The end portion (22) of the winding portion situated inside the spiral can be connected to a connection outside the spiral by means of a conductor (23), which crosses over the winding portion on a bridge of an electrically insulating material (24). The winding portion is provided on an insulating layer (25). The above-described solution is very laborious. For this reason, use is generally made of two windings which are interconnected by a via. Such a via is a metallized through-hole. One of the windings spirals inwards to the input of the via. The other winding is connected to the output of the via, where it spirals outwards. This is shown in FIGS. 3A and 3B.

Figure 3A:
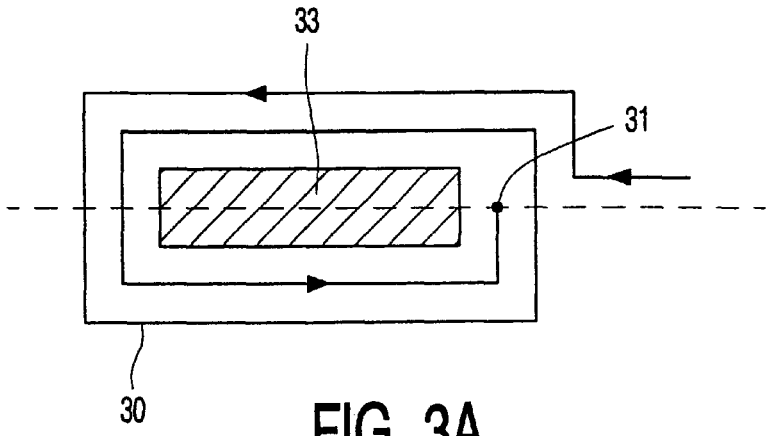
FIG. 3A PRIOR ART
FIG. 3A is a cross-sectional view of the prior art planar transformer shown in FIG. 1, at the location of one of the spiral-shaped winding portions of the secondary coil.
Figure 3B:
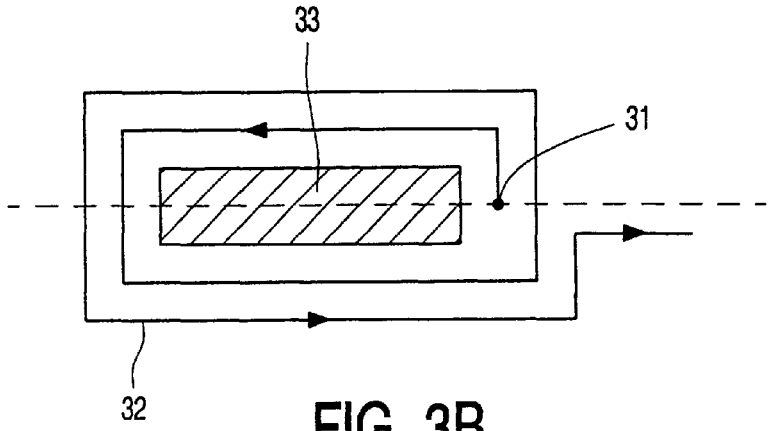
FIG. 3B PRIOR ART
FIG. 3B is a cross-sectional view of the prior art planar transformer shown in FIG. 1, at the location of one of the spiral-shaped winding portions of the secondary coil, which is connected to the winding portion shown in FIG. 3A.
Figure 4:
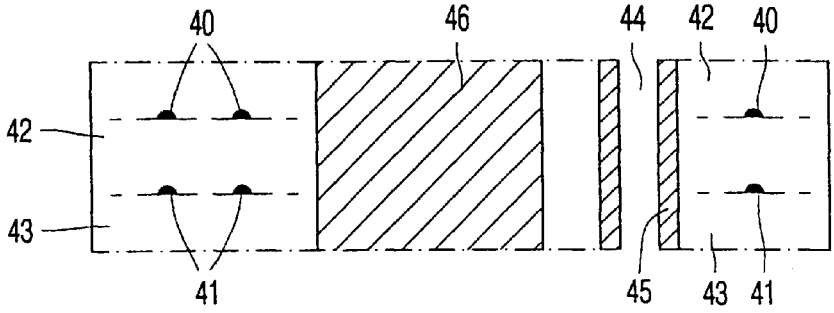
FIG. 4 PRIOR ART
FIG. 4 is a cross-sectional view of the prior art planar transformer shown in FIG. 3, at the location of the interrupted line.

FIG. 3A is a cross-sectional view of the prior art planar transformer of FIG. 1 at the location of one of the spiral-shaped winding portions of the secondary coil. The winding portion (30) extends inward in a spiral-like manner and is electroconductively connected to a via (31) situated inside the spiral thus formed. FIG. 3B is a cross-sectional view of the known planar transformer of FIG. 1 at the location of one of the spiral-shaped winding portions of the secondary coil, which is connected to the winding portion of FIG. 3A. This winding portion (32) extends from the via (31) to the outside in a spiral-like manner. The core is referenced (33). Of course, it is also possible to manufacture coils having several windings and hence several layers. Thus, this construction comprising vias enables coils in a flat plane to be connected, without bridges being required. FIG. 4 is a cross-sectional view of the planar transformer of FIG. 3 at the location of the interrupted line. FIG. 4 shows two winding portions (40, 41) which are provided on layers (42, 43) of an electrically insulating material. The winding portions are electroconductively interconnected by means of the via (44) having a metallized wall (45). The core of the transformer is referenced (46).

Preferably, the two winding portions which are situated on the outermost layers of the transformer belong to the same coil (the primary or the secondary coil). The reason for this being that the most suitable cores consist of a conductive material, so that the relevant core is considered to be a primary or secondary component, dependent on which winding is closest. The part of a path between a primary and a secondary coil which passes through the core does not form part of the distance. In an alternative construction it would be possible to choose a path through the core, such that the trajectory through the intermediate material is less than 0.4 mm.

It is possible, for example, to provide a stack of two layers with a secondary winding on either side with a stack of two layers with a primary winding. The core which is provided around this construction is then considered to be a primary component, since it is closest to the primary windings. The distance between the vias of the secondary windings must, in any case, be almost 6 mm to reduce the risk of breakdown to an acceptable level. An alternative construction comprises layers with a primary winding provided, on either side, with a stack of layers with a secondary winding. The core provided around this construction is considered to be a secondary component.

Figure 5A:
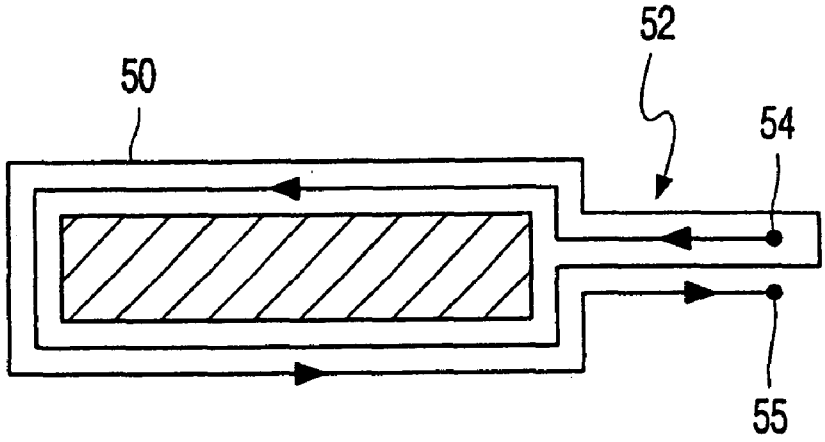
FIG. 5A is a cross-sectional view of an embodiment of the planar transformer in accordance with the invention, at the location of a spiral-shaped winding portion of the secondary coil.
Figure 5B:
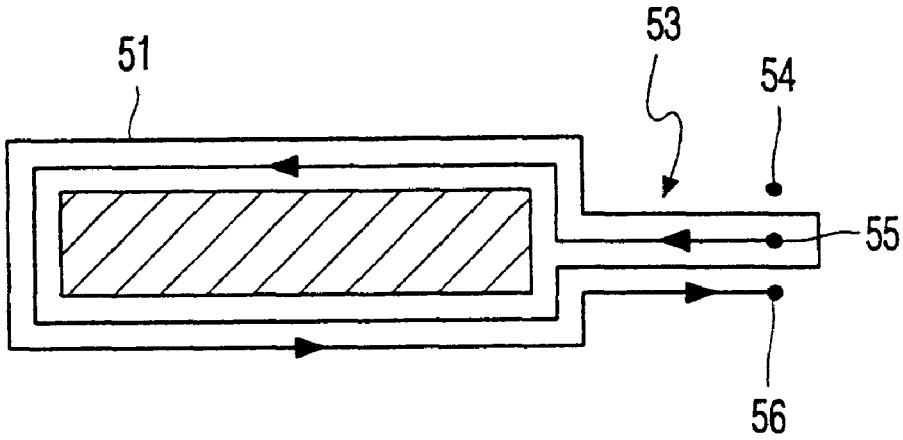
FIG. 5B is a cross-sectional view of the planar transformer shown in FIG. 5A, at the location of a spiral-shaped winding portion of the secondary coil, which borders on the winding portion of FIG. 5A.

In accordance with the invention, the track of a winding portion of the secondary coil has a protuberance. As shown in FIGS. 5A and 5B, the winding portions (50, 51) each have a spiral portion and outward extending portion (52, 53). The outward extending portion of the winding portion is situated at a larger distance from the core than the central portion. As a result, the vias (54, 55, 56), which interconnect two winding portions, may also be situated at a larger distance from the core as compared to the situation in which there is no protuberance. Consequently, it is possible to maintain the vias at the safe distance of at least almost 6 mm, while the transformer has been reduced in size.

Figure 6A:
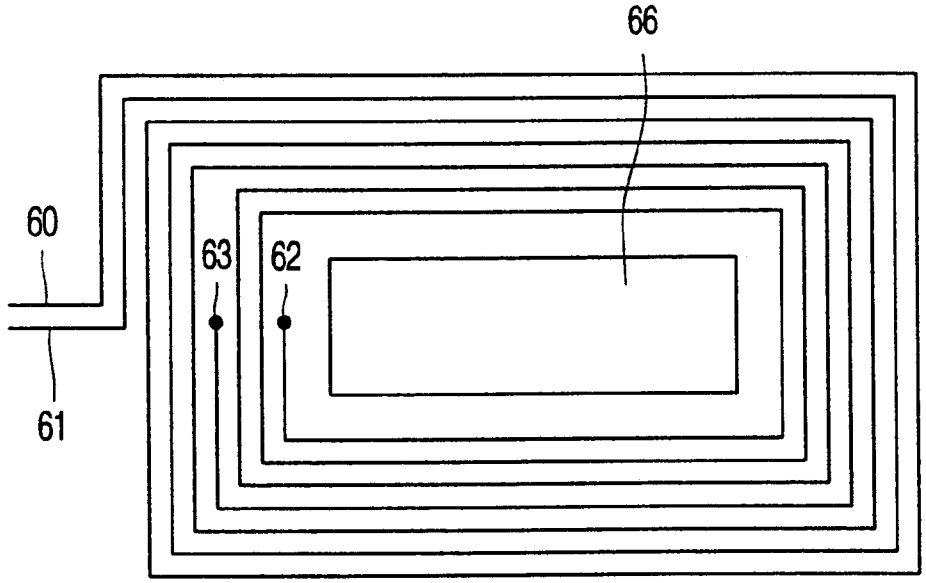
FIG. 6A is a cross-sectional view of an embodiment of the planar transformer in accordance with the invention, at the location of two of the spiral-shaped winding portions of a double-wound primary coil.
Figure 6B:
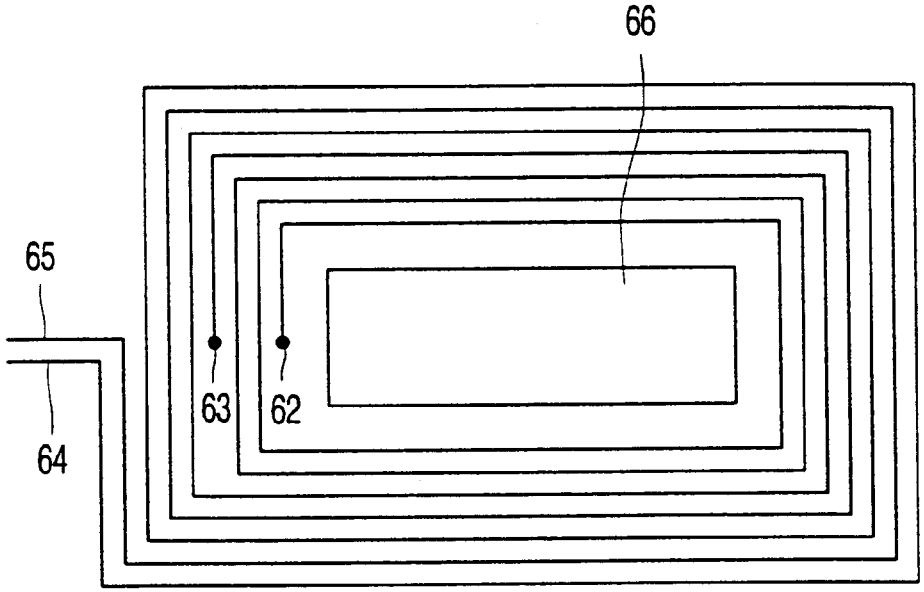
FIG. 6B is a cross-sectional view of the planar transformer, at the location of two of the spiral-shaped winding portions of the double-wound primary coil, which are connected to the winding portions shown in FIG. 6A.

Reduction of the size of planar transformers without increasing the risk of breakdown of the transformer during operation can alternatively be achieved by positioning two winding portions of a primary coil in a parallel, juxtaposed arrangement on a single layer. This enables a more compact and cheaper transformer to be manufactured. FIG. 6A shows two parallel winding portions (60 and 61), wound about core (66), which terminate, respectively, at the vias (62) and (63). FIG. 6B shows how winding portions (64) and (65) extend from the respective vias (62) and (63) to the outside in a spiral-like manner.

This method of arranging windings enables a smaller transformer to be produced. This method is important, in particular, in transformers comprising two primary coils, for example, a coil for the supply voltage and the switch, and a coil for the supply voltage of a control IC (integrated circuit). Otherwise, additional layers would be required.

Consequently, the invention relates to a planar transformer in which the turns of the secondary coil are externally interconnected, so that the vias are situated at a greater distance from the core. The invention further relates to a planar transformer in which turns of the primary coil are situated parallel to one another. In this manner, a further reduction in size of the transformer can be achieved without an increased risk of breakdown of the transformer during operation.

What is claimed is:

1. A planar transformer comprising:

a plurality of insulating layers;

a first coil formed on a first layer of said plurality of insulating layers, said first coil having a first central winding portion and a first extending portion, said first extending portion outwardly extending from said first central portion and surrounding a first via; and a second coil formed on a second layer of said plurality of insulating layers, said second coil having a second central winding portion and a second extending portion, said second extending portion outwardly extending from said second central portion and surrounding a second via;

wherein said first via and said second via are located outside said first central winding portion and said second central winding portion, and wherein one of said first via and said second via connects said first extending portion to said second extending portion, said first coil and said second coil being located on different planes.

2. The planar transformer of claim 1, wherein said plurality of insulating layers include two layers each having one of said second coils, and four layers each having one of said first coils.

3. The planar transformer of claim 1, further comprising a ferrite core extending through the first coil and the second coil.

4. The planar transformer of claim 3, wherein the ferrite core is situated closer to the first coil than to the second coil, wherein an overall distance from the vias to the core is in excess of 6 mm.

5. The planar transformer of claim 1, wherein said first coil and said second coil are located on opposite surfaces on one of said plurality of insulating layers.

6. The planar transformer of claim 1, wherein said first coil and said second coil are located on different ones of said plurality of insulating layers.

7. A planar transformer comprising:

an insulating layer;

a first coil formed on a surface of said insulating layer and having a first extending portion; and a second coil formed on said surface of said insulating layer and having a second extending portion;

wherein said first extending portion and said second extending portion are parallel to each other and coil together in parallel to form a central winding portion.

8. The planar transformer of claim 7, further comprising:

a third coil formed on a further surface of said insulating layer and having a third extending portion; and a fourth coil formed on said further surface of said insulating layer and having a fourth extending portion;

wherein said third extending portion and said fourth extending portion are parallel to each other and coil together in parallel to form a further central winding portion.

9. The planar transformer of claim 7, further comprising:

a further insulating layer;

a third coil formed on said further insulating layer and having a third extending portion; and a fourth coil formed on said further insulating layer and having a fourth extending portion;

wherein said third extending portion and said fourth extending portion are parallel to each other and coil together in parallel to form a further central winding portion.

* * * * *